United States Patent [19]

Klar et al.

[11] Patent Number: 4,861,373

[45] Date of Patent: Aug. 29, 1989

[54] INFILTRATED POWDER METAL PART HAVING IMPROVED IMPACT STRENGTH TENSILE STRENGTH AND DIMENSIONAL CONTROL AND METHOD FOR MAKING SAME

[75] Inventors: Erhard Klar, Beachwood; Mark Svilar, Orange Village; David F. Berry, Westlake, all of Ohio

[73] Assignee: SCM Metal Products, Inc., Cleveland, Ohio

[21] Appl. No.: 165,587

[22] Filed: Mar. 8, 1988

Related U.S. Application Data

[63] Continuation-in-part of Ser. No. 935,854, Nov. 28, 1986, Pat. No. 4,731,118, which is a continuation-in-part of Ser. No. 879,502, Jun. 25, 1986, abandoned, which is a continuation-in-part of Ser. No. 866,184, May 20, 1986, abandoned.

[51] Int. Cl.[4] ..... C22C 29/14

[52] U.S. Cl. ..... 75/244; 75/246; 419/10; 419/11; 419/27; 419/29; 419/30; 419/58

[58] Field of Search ..... 75/244, 246; 419/10, 419/11, 24, 27, 30, 58

[56] References Cited

U.S. PATENT DOCUMENTS

| | | | |
|---|---|---|---|
| 4,437,890 | 3/1984 | Hayasaka et al. | 419/27 |
| 4,606,768 | 8/1986 | Svilar et al. | 419/27 |
| 4,731,118 | 3/1988 | Svilar et al. | 419/27 |
| 4,769,071 | 9/1988 | Klar et al. | 75/246 |

*Primary Examiner*—Stephen J. Lechert, Jr.
*Attorney, Agent, or Firm*—Lieberman Rudolph & Nowak

[57] ABSTRACT

The present invention relates to an infiltrated ferrous powder metal part containing certain additives, yielding a radically improved unnotched impact strength without sacrificing tensile strength. Fatigue strength is also improved. In addition, improved dimensional control is obtained during infiltration. The microstructure is also improved, with smoothing or rounding of the formerly sharp angled copper filled pores. The invention also comprises the method of achieving these results.

35 Claims, No Drawings

INFILTRATED POWDER METAL PART HAVING IMPROVED IMPACT STRENGTH TENSILE STRENGTH AND DIMENSIONAL CONTROL AND METHOD FOR MAKING SAME

RELATED CASES

This application is a continuation in part of application Ser. No. 935,854 which was filed on Nov. 28, 1986, now U.S. Pat. No. 4,731,118 which was a continuation in part of application Ser. No. 879,502 filed on June 25, 1986, now abandoned, which was in turn a continuation in part of application Ser. No. 886,184 filed May 20, 1986, now abandoned.

BACKGROUND OF THE INVENTION

Ferrous powder metal (P/M) parts which are produced by conventional pressing and sintering processes, typically exhibit low impact and fatigue strength due to pores remaining in these parts after sintering. For many years however, these dynamic properties have been improved by infiltrating the sintered parts with copper or a copper based alloy, in an attempt to reach near full density. Although significant improvements in tensile and fatigue strength have been achieved, the improvement in impact strength has until recently been insufficient to permit use as high performance parts, which currently are thus made by more expensive powder forging and hot pressing methods.

Increased tensile and fatigue strengths have been achieved by heat treating an infiltrated part, however this typically results in reduced impact strength. Improvement in tensile and fatigue strength without loss of impact strength (toughness) and ductility would be an important advance toward the acceptance of infiltrated ferrous parts for high performance applications.

Prior to its commercialization in about 1946, copper infiltration of ferrous parts suffered from large positive dimensional changes (also known as growth or swelling) taking place during infiltration. Of the growth-controlling additives known and used in the pressing and sintering of P/M parts, i.e., phosphorus, boron, carbon, lithium, silver, in the elemental or alloy form, carbon in the form of graphite came to be used exclusively for copper infiltration of ferrous parts. Carbon not only decreased the large positive dimensional changes down to manageable levels but also brought about desirable and clean reduction of oxides. It is for these reasons that today graphite additions corresponding to a combined carbon content (based on the iron content of the copper infiltrated part) from about 0.5% to about 0.8% are most commonly used in the industrial practice of copper infiltration of ferrous parts. At these levels of carbon, overall growth can be kept below about 0.7%.

There is, however, another phenomenon known as distortion that appears to be specific and peculiar to copper infiltrated parts. Distortion refers to the non-uniform, often erratic, dimensional changes taking place during infiltration, which cause dimensional tolerances of copper-infiltrated ferrous parts to be substantially inferior to those obtained by pressing and sintering. P/M parts made by pressing and sintering are often sized to improve dimensional tolerances. Infiltrated ferrous parts, however, do not respond very well to sizing because of their high strength and high density. Distortion is thereby an even more serious problem for copper infiltrated parts and a solution to this problem would enable a wider application of copper infiltration.

PRIOR ART

Sintering is a process by which powder metal particles are atomically bonded together at temperatures below the melting point of the metal particles. The power metal for purposes of this application can be made of iron or steel, or alloys thereof. These can include carbon steel, tool steels, stainless steel and low alloy steels.

After sintering takes place, pores remain in the sintered compact surrounded by the grain boundaries formed during the sintering process.

For many years, parts made by sintering have been strengthened by infiltration of these pores using copper or copper alloy infiltrants. Typically a tensile strength of 87 ksi can be obtained with 0.8% combined carbon and 5–15% Copper (MPIF Std. 35 FX1008). However, typically, the impact strength of such an infiltrated part has an unnotched Charpy value of only about 10 ft. lbs. Impact strength is conventionally measured in foot pounds using the Charpy impact test procedure described in the Metal Powder Industries Federation (MPIF) Standard 40.

Impact strength of an infiltrated part can be increased by heat treatment after infiltration, as described in U.S. Pat. No. 4,606,768, assigned to SCM Metal Products. This patent described an infiltration process which produces parts having an unnotched impact strength of up to about 130 ft. lbs. and a tensile strength of about 103 ksi. These properties were achieved by minimizing erosion and residual porosity and maximizing ductility of the steel matrix by means of heat treatment. Combined carbon content of 0.7–0.9% was preferred for considerations of high tensile strength and low dimensional change.

The instant application is a continuation in part of U.S. patent application Ser. No. 935,854 which was filed on Nov. 28, 1986, now U.S. Pat. No. 4,731,118, the contents of which is specifically incorporated by reference herein. When combined with the processes taught in U.S. Pat. No. 4,606,768, the '854 application describes a process capable of producing parts with unnotched impact strengths of over 240 ft. lbs. at ultimate tensile strengths of over 100 ksi. This improvement was achieved by utilizing shorter infiltration times and by selecting raw materials having a higher purity.

The '854 application also shows improvement in unnotched impact strength at high tensile strength. For instance, unnotched impact strengths of 25–28 ft. lbs. were obtained at a tensile strength of 184 ksi; previous commercial practice gives typical unnotched impact strengths of only 6.5 ft. lb. at 120 ksi. However, for high performance applications as previously described, toughness (as measured by impact strength) at high tensile strength needs to be further improved; also improvement of tensile strength would extend application to high performance parts requiring higher fatigue strengths. Concomitant with the above improvements, dimensional control and freedom from distortion must be maintained.

Dimensional change in sintered iron/copper parts is generally controlled in commercial P/M practice by adding graphite for a combined carbon content of about 0.5% to about 0.8%. At these levels growth typically can be kept below 0.4% and dimensional tolerances are adequate. Distortion is not a significant problem. Nevertheless, in some cases, the addition of phosphorus (as an alloy of copper or iron) has been used to supplement carbon as a growth controller; both carbon and phosphorus increase tensile strength but usually decrease ductility.

Boron has been used as an addition in various P/M processes. In nickel and cobalt-based hard-facing alloys, boron acts as a fluxing agent for oxide films and controls the hardness of the resultant spray-fused deposit. During the water atomization process whereby these powders are made, boron confers a spherical shape to the powder.

Boron is also used to increase the wear resistance of iron/copper/carbon alloy P/M parts (U.S. Pat. No. 4,678,510) where boron levels are 0.15–1.2%; boron also promotes sintering at these levels by forming a transient liquid phase.

Boron has also been used as a substitute for phosphorus in the making of leaded copper powders by atomization. Both additives were found to deoxidize the molten alloy prior to atomization and to promote a spherical shaped particles, (West German Pat. No. 2635959). During subsequent processing, where a layer of the leaded copper powder is sintered on to a steel backing plate as an initial step in the manufacture of journal bearings, phosphorus caused formation of a brittle iron phosphide compound at the interface; boron did not have this adverse effect.

U.S. Pat. No. 4,437,890 describes a method of preparing a high density sintered alloy of iron/copper in which boron is added to limit growth during sintering. Boron was used instead of carbon which also controlled dimensional change but made the ferrous part too strong for subsequent sizing; thus boron was taught to decrease strength, not to increase it. In addition, the patent does not teach the use of boron with an infiltration process subsequent to sintering.

A paper by Hayasaka et al. (Japan Journal of Powder and Powder Metallurgy, Vol. 31, No. 6 (1984)) describes the addition of boron to improve the tensile strength after heat treatment using a process of compacting, sintering and carburizing. The process did not however include infiltration.

It is, therefore, an object of the instant invention to provide an infiltrated powder metal part which exhibits superior impact strength, tensile strength and fatigue strength.

It is another object of the invention to provide an infiltrated powder metal part which exhibits improved dimensional control and decreased distortion during infiltration.

It is a further object of the invention to provide an infiltrated powder metal part which is suitable for high performance use, such as a machine gear, which is equivalent to parts now being made by more expensive processes such as hot pressing and powder forging.

DISCLOSURE OF THE INVENTION

The invention resides principally in the discovery that adding certain additives, e.g. boron, either in pure form or as an alloy, to a metal powder mix which is sintered and then infiltrated with a copper or copper alloy infiltrant, yields a part with vastly superior unnotched impact strength as well as improved tensile strength, fatigue strength and ductility. Furthermore, the use of the additive rounds off the formerly sharp angled copper-filled pores and decreases distortion during infiltration.

As a result, the instant invention now makes possible many new applications where the improved properties are essential. Examples from the automotive, appliance, business equipment, hardware and many other industries include the following parts: torque converter hubs; lawn and garden tractor transmission gears; gears for the appliance industry; automotive transmission gears; connecting rods; stators, vanes, valve blocks, pumps for the fluid power industry; ratchet gears; governor weights; bearing collars; flexible power couplings; compressor valve blocks; lock parts; valve seat inserts.

The present invention although particularly described herein with reference to the infiltration of ferrous powder metal parts employing copper based materials as infiltrants, is not limited to such metals.

In order to better teach the instant invention to those skilled in the art, the following examples are provided:

EXAMPLE I

Following procedures described in parent U.S. patent application Ser. No. 935,584, Izod impact test bars made of iron powder (Hoeganaes A1000PF), with about 0.5% graphite (Lonza KS2.5) plus about 0.75% of Acrawax (Glyco) lubricant and varying amounts of boron in the form of a ferroboron alloy containing 3.8% boron, were compacted to a density of about 7 g/cc, vacuum sintered at about 2050° F. for about 30 minutes and subjected to infiltration in vacuum for about 7 minutes using an infiltrating powder (SCM grade IP-204) in the amount of about 14% by weight of the ferrous content of the part, pressed to a density of about 7 g/cc.

After shortening to standard Charpy length, the infiltrated bars were austenitized at about 1650° F. for about 30 minutes, then water quenched, and tempered for about one hour at about 350° F. Tensile test bars were machied from the Izod impact bars.

Unnotched impact strength and tensile properties were determined for test bars prepared as described above, the amounts of boron varying from about 0% to about 0.05% by weight of the infiltrated part. The results are described in Table I below. Also included for comparison are results obtained by current commercial infiltration practice (MPIF Std. 35, FX1005-110HT) and those of an iron/0.9% C (graphite) mix using procedures described in copending application 935,854, now U.S. Pat. No. 4,731,118. The numbers separated by semicolons represent separate test runs.

TABLE I

| | | Fe/0.5% C added | | Fe/ 0.9% C | FX 1005-110HT |
|---|---|---|---|---|---|
| % Boron | 0 | 0.02 | 0.05 | 0 | 0 |
| Unnotched impact strength (ft. lbs.) | 21;25;25 | 38;55;56 | 88;97;98 | 25 to 28 | 7 |
| Tensile strength | 152;177 | 221;229 | 233;234 | 184 | 120 |
| 0.2% offset yield strength | * | 196;203 | 200;224 | * | * |
| Elongation (%) | <0.5 | 2.3 | 2.3 | <0.5 | <0.5 |

*yield strength equal to tensile strength for elongation below

From these results it is apparent that the addition of boron increases unnotched impact strength by up to about 300% to 400%; tensile strength is increased by up to about 30% to about 40%.

In comparison to the boron-free materials of Example I, the microstructure of the boron-containing materials show a rounding-off or smoothing of the copper-filled pores which is progressive with the amount of boron added. Also the fracture surface of the boron-containing materials show a progressively uniform greyer color as the boron addition increases; in contrast the fracture surfaces of the boron-fee materials which have characteristic uniform copper color.

EXAMPLE II

Using processing conditions as applied in Example I but no heat treatment after infiltration, unnotched impact strengths were as follows:

TABLE II

| % Boron | 0 | 0.02 | 0.05 |
|---|---|---|---|
| Unnotched Impact Strength (ft. lb.) | 80;86 | 172;174 | 155 |

It can be seen that improved unnotched impact strengths are also possible in the as-infiltrated condition.

EXAMPLE III

Izod impact bars made of iron powder (Hoeganaes A1000PF), plus about 0.9% graphite (Lonza KS2.5), plus about 0.75% Acrawax (Glyco) plus about 0.02% boron in the form of −270 mesh ferroboron powder containing about 3.8% boron, were compacted to a density of about 7 g/cc and sintered in vacuum for about 30 minutes at a temperature of about 2050° F. An SCM IP-204LD infiltrant slug weighing about 7% of the impact bar was placed on each end of the sintered impact bars which were then infiltrated in vacuum at about 2050° F. for about 7 minutes. Reference impact bars were also prepared containing no boron.

The bars were measured for length and percent dimensional change was calculated. Width was measured in 3 places (each end and in the middle of the bar) and distortion is expressed as the differences between middle and end percent dimensional changes in Table III below.

TABLE III

| | Dimensional Change % | |
|---|---|---|
| | Length | Width Distortion |
| Fe + 0.9 C | +0.08 | 0.21 |
| Fe + 0.9% C + 0.02% B | −0.03 | 0.09 |

These results demonstrated that the addition of boron decreases distortion while having a small effect on length dimensional change.

EXAMPLE IV

Izod bars were prepared as in Example III but with a graphite (Carbon) content of 0.5%. The results are described in Table IV.

TABLE IV

| | Dimensional Change % | |
|---|---|---|
| | Length | Width Distortion |
| Fe + 0.5 C | +0.43 | 0.31 |
| Fe + 0.5% C + 0.02% B | −0.07 | 0.22 |

The results demonstrate that distortion can be decreased even at lower carbon levels.

EXAMPLE V

Izod bars were prepared as in Example IV except that infiltration time was about 30 minutes instead of 7 minutes. The results are described in Table V.

TABLE V

| | Length Dimensional Change (%) |
|---|---|
| Fe + 0.5% C | +0.95 |
| Fe + 0.5% C + 0.02% B | +0.01 |

The results demonstrate that the addition of boron not only decreases distortion resulting from infiltration, particularly for short infiltration times, but it also stabilizes dimensional change at a low level during longer infiltration times with accompanying improvement in dimensional control.

Although the specific examples described herein utilized the processes of infiltration described in parent application Ser. No. 935,584, it is to be understood that the invention can also be applied to conventional infiltration methods. Improvements in the control of dimensions and distortion can be expected with powder mixes having a high carbon content, e.g. about 0.9% as well as lower carbon levels; yielding a part with superior impact strength, tensile strength and ductility. Improvements in the control of dimensions and distortion can also be expected with infiltrated parts having densities of only about 7.4 g/cc and even about 7.2 g/cc.

While it is not intended that the instant invention be limited to a particular explanation for the above, it is believed that the main mechanism responsible for the improved properties resides in the effect that the additive, e.g. boron has on the infiltrated part. During infiltration, the boron tends to round off the otherwise sharply notched copper-filled pore structure. Without the boron addition, the angle of the notches formed between adjacent iron particles become sharper and larger as infiltration progresses.

Phosphorus, arsenic and antimony are also believed to render a similar microstructure on account of their solubilities in iron, changes of di-hedral angles (ref. W. Salter J. Iron and Steel Inst. Vol. 204, 1966 p. 478) and effects on dimensional change.

The foregoing disclosure and examples are provided to illustrate and explain the invention and it is to be understood that they in no way limit the scope of the invention or the appended claims.

We claim:

1. A copper infiltrated ferrous powder metal part having an effective amount of an additive for improving the microstructure resulting in rounded-off copper-filled pores.

2. The metal part of claim 1 wherein the additive contains boron.

3. The metal part of claim 1 wherein the boron content is in the range of about 0.002% to about 0.20% by weight of the infiltrated part.

4. The metal part of claim 1 wherein the boron content is in the range of about 0.02% to about 0.08% by weight of the infiltrated part.

5. The metal part of claim 1 wherein the additive contains phosphorus.

6. The metal part of claim 1 wherein the additive contains arsenic.

7. The metal part of claim 1 wherein the additive contains antimony.

8. The metal part of claim 1 wherein the additive contains two or more of the additives boron, phosphorus, arsenic, antimony.

9. The metal part of claim 1 wherein the infiltrated phase consists of copper or copper alloy.

10. The metal part of claim 1 wherein carbon is present in the iron phase in the range of about 0.1% to about 1.1% by weight.

11. The metal part of claim 1 where carbon is present in the iron phase in the range of about 0.25% to about 0.8% by weight.

12. The metal part of claim 1 wherein the iron phase is plain carbon steel, tool steel, low alloy steel or stainless steel.

13. The metal part of claim 9 wherein the infiltrated phase is copper alloyed with alloying constituents selected from the group consisting of iron, tin, zinc, silver, lithium, silicon, manganese, chromium, zirconium, aluminum, nickel, phosphorus, arsenic, antimony, magnesium, cobalt and boron and combinations thereof.

14. The metal part of claim 1 having an unnotched Charpy impact strength of greater than about 28 ft. lb. and a tensile strength of greater than about 184 ksi.

15. The metal part of claim 2 having an unnotched impact strength of greater than about 28 ft. lb. and a tensile strength greater than about 184 ksi.

16. The metal part of claim 1 wherein distortion due to infiltration is minimized.

17. The metal part of claim 14 wherein distortion during infiltration is minimized.

18. A process for infiltrating ferrous powder metal parts which produces parts with impact strength as measured by unnotched Charpy test of greater than about 28 ft. lb. and a tensile strength of greater than about 184 ksi, said process comprising the steps of:

a. adding an additive to the ferrous powder mix;

b. pressing said powder mix into a compact;

c. sintering said compact;

d. infiltrating said sintered compact with an infiltrant.

19. Process of claim 18 wherein said infiltrant is copper or copper alloy.

20. The process of claim 18 wherein the additive contains boron in the form of boron or boron alloy.

21. The process of claim 18 wherein said ferrous powder mix contains carbon in the range of about 0.2% to about 1.1%.

22. The process of claim 18 wherein said ferrous powder mix contains carbon in the range of about 0.3% to about 0.9%.

23. The process of claim 18 wherein the additive to the ferrous powder mix is phosphorus.

24. The process of claim 18 wherein the additive to the ferrous powder mix is arsenic.

25. The process of claim 18 wherein the additive to the ferrous powder mix is antimony.

26. The process of claim 18 wherein the additive to the ferrous powder mix is two or more of the following: boron, phosphorus, arsenic, antimony.

27. The process of claim 18 wherein said sintering and infiltration take place under vacuum in two separate steps.

28. The process of claim 18 wherein said sintering and infiltration take place under vacuum in one step.

29. The process of claim 18 wherein sintering and infiltration take place in a reducing atmosphere with a low dew point.

30. The process of claim 18 wherein the reducing atmosphere is dissociated ammonia.

31. The process of claim 18 wherein boron in the infiltrant is a boron or boron alloy.

32. Process of claim 19 wherein said infiltrant powder mix contains copper with additives, in elemental or alloy form, selected from the group consisting of iron, tin, zinc, silver, lithium, silicon, cobalt, manganese, chromium, zirconium, aluminum.

33. Process of claim 19 comprising the additional step of austenitizing, quenching and tempering the infiltrated ferrous part.

34. A distortion free ferrous infiltrated powder metal part having improved dimension control, comprising:

ferrous powder metal which is sintered in combination with carbon present in an amount ranging from 0.5 to 0.9%, the ferrous powder metal having pores;

copper or a copper metal alloy infiltrated into the ferrous powder metal and carbon in an amount sufficient to fill the ferrous powder metal pores, and;

boron present in an amount effective to (a) cause rounding off of the copper filled pores and (b) minimize distortion due to infiltration.

35. The part described in claim 34 wherein the boron is present in an amount ranging from 0.002% to 0.02%.

* * * * *